United States Patent [19]

Strahman

[11] 4,089,470

[45] May 16, 1978

[54] PLURAL FLUIDS DELIVERY SYSTEM

[75] Inventor: Richard D. Strahman, Livingston, N.J.

[73] Assignee: Strahman Valves, Inc., Florham Park, N.J.

[21] Appl. No.: 740,200

[22] Filed: Nov. 9, 1976

[51] Int. Cl.[2] ..... B05B 7/04; B05B 7/12

[52] U.S. Cl. ..... 239/304; 137/563; 137/604; 15/321

[58] Field of Search ..... 239/127, 304, 310, 373; 137/206, 563, 604; 15/302, 320, 321

[56] References Cited

U.S. PATENT DOCUMENTS

| | | | |
|---|---|---|---|
| 2,931,580 | 4/1960 | Johnson | 239/310 X |
| 2,934,314 | 4/1960 | Chambers et al. | 137/604 X |
| 3,037,707 | 6/1962 | Ligon | 239/310 |
| 3,318,535 | 5/1967 | New | 239/310 |

*Primary Examiner*—Robert W. Saifer

*Attorney, Agent, or Firm*—Carella, Bain, Gilfillan & Rhodes

[57] ABSTRACT

Toward apparatus for providing selectively a stream of one or a combination of first and second fluids is disclosed to include independent storage means for the fluids, pressure generating means for the respective fluids, atmospheric break means to preclude backwash of fluids and mixing means for selectively mixing the fluids as desired for delivery to a site.

3 Claims, 3 Drawing Figures

PLURAL FLUIDS DELIVERY SYSTEM

BACKGROUND OF THE INVENTION

This invention relates to apparatus for providing selectively a stream flow of a first liquid and a stream flow of a combination of the first liquid and a second liquid.

It has been recognized in the art that it is desirable to inject a fluid product into a fluid carrier, e.g. to inject a detergent into a flow of water, for a variety of reasons. See e.g. U.S. Pat. No. 3,698,644. Thus, in the commercial cleaining of floors, walls, tiled areas and the like, the selective insertion of a detergent into a flow of water for discharge through a single nozzle permits the soaping and rinsing of the work surface using a single tool.

Known apparatus for these purposes have been unsatisfactory for purposes of adjusting the amount of detergent per volume of primary liquid, have utilized two nozzles rather than a single nozzle thus rendering them susceptible to clogging, have utilized portalbe detergent containers which either limits the amount of detergent available or which makes the apparatus clumsy and difficult to handle, or have resulted in the contamination of fresh water systems by reason of the ability of a malfunction of the detergent valve to permit communication of the detergent with the fresh water supply.

SUMMARY OF THE INVENTION

It is an object of the present invention, therefore, to provide a dual liquid stream apparatus which utilizes a single nozzle for delivering selectively, a stream of a first liquid or a stream of the first liquid combined with a second liquid.

Another object of the present invention is to provide a dual liquid stream apparatus wherein both a first and second liquid are delivered to a single nozzle under a positive pressure.

A further object of the present invention is to provide a dual liquid stream apparatus wherein it is impossible for the second liquid to come into fluid communication with the source of supply of the first liquid.

These objects and others not enumerated are achieved by the apparatus according to the present invention, one embodiment of which may include containers for first and second liquids an air break between a source of the first liquid and the liquid stored in the first liquid containers, pressurizing means for increasing the pressures of the first and second liquids, a mixing value for selectively mixing the first and second liquids and nozzle means for discharging the liquids as desired.

BRIEF DESCRIPTION OF THE DRAWINGS

A more complete understanding of the present invention may be had from the following detailed description thereof particularly when read in the light of the accompanying drawings wherein.

DETAILED DESCRIPTION

Figure 1:
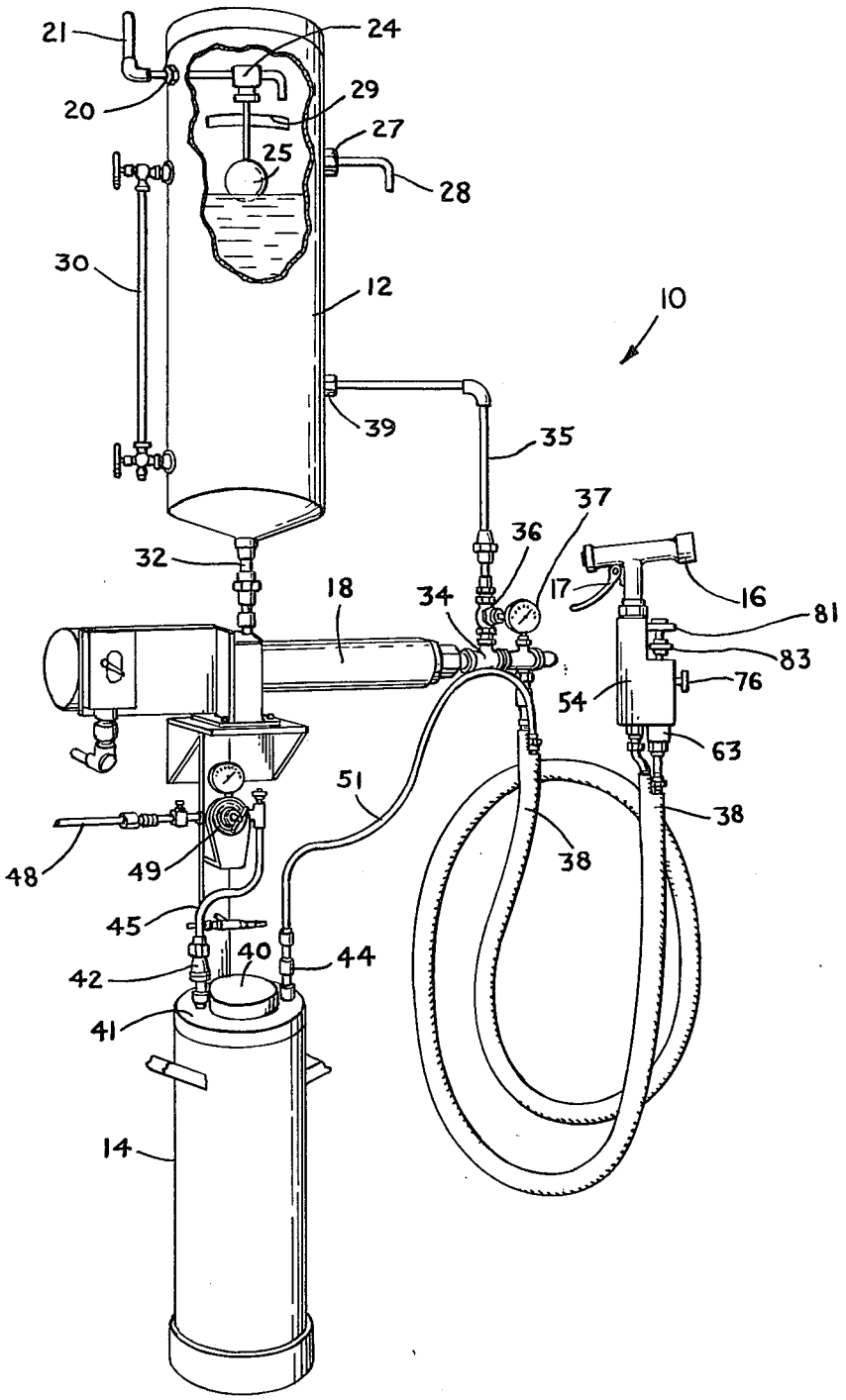
FIG. 1 is a perspective view, partially cutaway, of apparatus according to the invention.

This invention relates to apparatus for providing selectively a stream flow of a first liquid and a stream flow of a combination of the first liquid and a second liquid. For purposes of detailed description the invention is disclosed in the context of an apparatus for mixing and delivering water as the first liquid and a liquid detergent as the second liquid. Accordingly, in FIG. 1, there is shown a cleaning apparatus structured in accordance with the teaching of the present invention and designated generally by the reference numeral 10.

Apparatus 10 can be seen broadly to include a first liquid storage tank 12 for storing a first liquid, in this case water; a second liquid storage tank 14 for storing a second liquid, in this case a liquid detergent; a nozzle means 16 having a valve means 17 for selectively interrupting flow of liquid therethrough or for discharging a flow of either the first liquid or a combination of the first and second liquids; and a pump 18 for generating a pressure head in the first liquid for delivery through nozzle 16.

As noted above, the first liquid in the described apparatus 10 is water. Thus, as can be seen in FIG. 1, there is provided at the upper end of tank 12 a water inlet connection 20. City water may be used to fill tank 12 and may be introduced thereto through water pipe 21 and a float-operated shut-off valve 24. The float 25 of valve 24 extends into tank 12 to float on the surface of the water such as to permit filling when the water surface dips below a pre-selected level and to terminate filling when the water surface reaches a maximum pre-selected level.

The maximum pre-selected allowable level of water in tank 12 is below the position of a connection 27 for a drain pipe 28. Thus, in the event there is a malfunction of float valve 24, the level of the water in tank 12 will rise no higher than the level of drain connection 27. This positioning of drain 27, i.e. at a vertical position which is displaced downwardly from a level of the discharge from valve 24, cooperates therewith to define an atmospheric break which precludes backwash of fluid from tank 12 into the source water system through pipe 21. Known systems have not provided such an atmospheric break and have, on occasion, been responsible for the contamination of fresh water supply systems to which they were connected. Additionally, in order to produce for the possibility of drain line clog, a spill slot 29, formed in the wall of tank 12 is provided slightly above the level of drain connection 27 to insure the atmospheric break capability as discussed above.

It has been found to be desirable to be able to determine accurately the level of water in tank 12. Thus there is provided on tank 12 a sight glass 30 suitable for this purpose. It will be recognized, however, that provision of such a sight glass is not necessary to the invention.

Disposed in the bottom of tank 12 is an outlet line 32 which accommodates the passage therethrough of the first liquid from tank 12 to the inlet connection of pump 18. In this regard, pump 18 in the embodiment shown is an electric motor driven, axial-discharge, centrifugal pump. However, there is no crticality to the choice of pump and any continuous discharge pump generally known to those skilled in these arts may be utilized.

Pump 18 discharges into one orifice of a tee connection 34, a second orifice of which is connected to a re-circulating line 35 through pressure regulator 36 and the third orifice of which is connected to a pressure gage 37 through which water may pass into a hose 38 ultimately for delivery to nozzle 16.

Recirculating line 35 extends from tee 34 and regulator 37 upwardly to a recirculation connection 39 disposed in the side of tank 12. Connection 39 is positioned below drain connection 27 and below inlet connection 20 so as to deliver recirculation water at a level within the body of water within tank 12.

Second liquid storage tank 14, which in the disclosed embodiment is a tank for storing liquid detergent, is a tank having a removable top 40 to permit charging of the tank with fluid. The cover 41 of tank 14 in which top 40 is removably mounted is provided with a first connector 42 and a second connector 44. First connector 42 accommodates the connection to tank 14 of a high pressure air line 45 which is provided from a source line 48 through a regulator 49. In this regard, ordinarily available high pressure air from existing systems in the range of 40 to 100 p.s.i. is perfectly satisfactory for use.

Second connector 44 is connected to a draw line (not shown) which provides for the flow of liquid from near the bottom of tank 14 for discharge through connection 44 into an outlet line 51 which is connected to a second conduit of hose 38.

In the embodiment shown, hose 38 is a twin line hose, one conduit of which is connected to the water supply and the second conduit of which is connected to outlet line 51 defining the soap supply. The distal end of hose 38 is connected to a mixing valve 54 which in turn is connected to nozzle 16.

Figure 2:
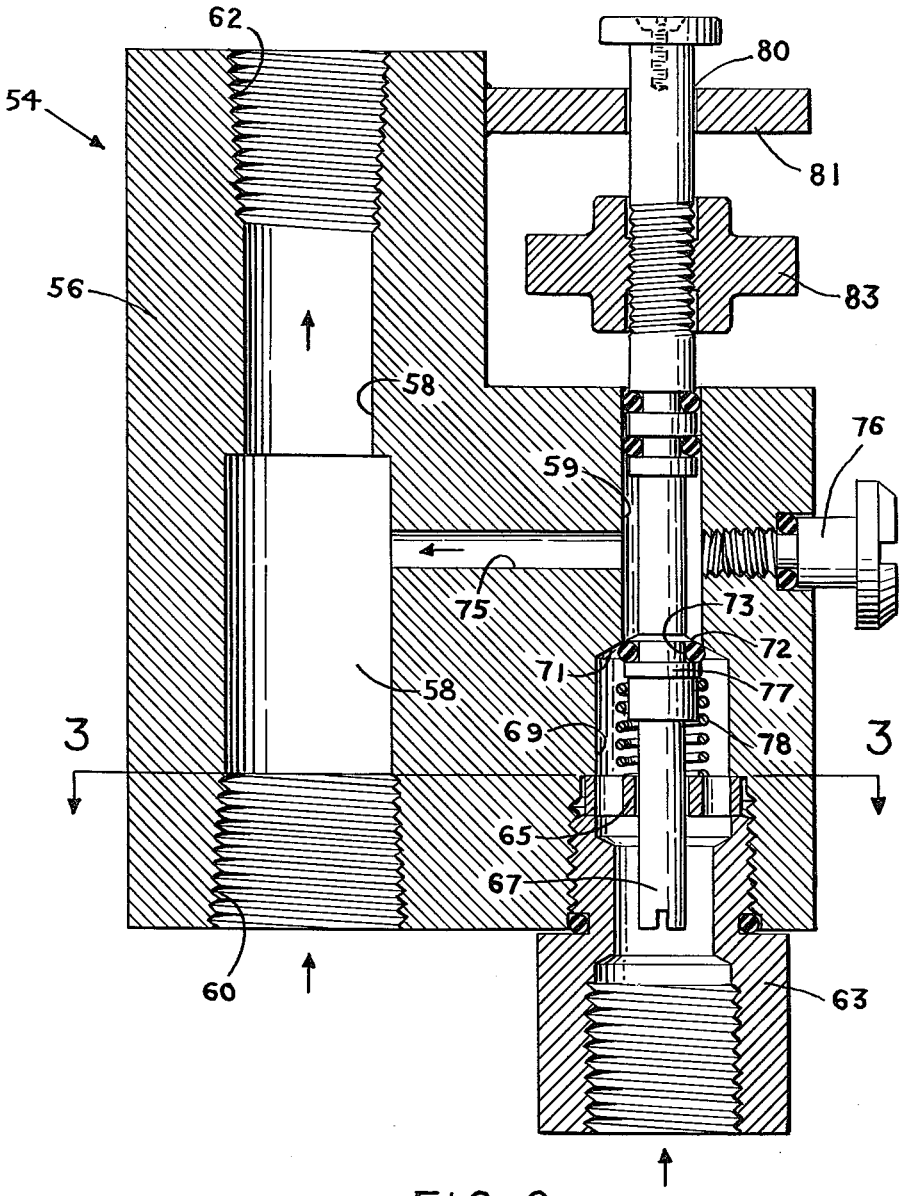
FIG. 2 is a cross-sectional elevational view of a mixing valve for use with the present invention.
Figure 3:
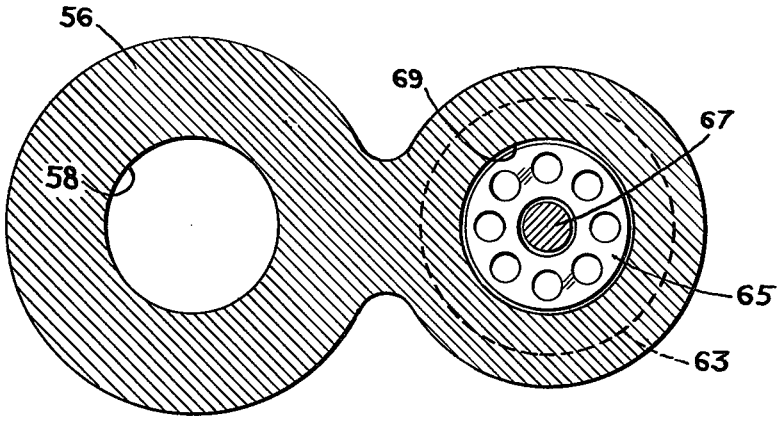
FIG. 3 is a cross-sectional elevational view through the plane 3—3 of FIG. 2.

Referring therefore to FIGS. 2 and 3, there is shown cross-sectional elevational views of mixing valve 54. Valve 54 can be seen to comprise a valve body 56 having first and second, generally parallel spaced bores 58, 59 extending therethrough.

First bore 58 defines a first inlet opening 60 and an outlet opening 62 through which fluid passes on its way to nozzle 16. First inlet opening 60 is designed for connection to that conduit of hose 38 through which passes the first liquid, i.e. water.

Second bore 59 is threaded at one end to accommodate the sealed threaded engagement therein of a connector 63. Connector 63 is designed for connection to that conduit of bore 38 through which passes the second liquid, i.e. soap. The inner end of connector 63 defines a retainer 65 for a valve stem 67 which is disposed for axial displacement within second bore 59. More specifically, second bore 59 is provided with a coaxial counter-bore 69 which extends partially through body 56. The juncture of bore 59 and counter-bore 69 defines a shoulder 71 which acts as a seat for an O-ring seal 72 mounted in an annular channel 73 formed on stem 67. Thus, when the surface of O-ring seal 72 engages shoulder 71, fluid is precluded from passing from counter-bore 69 into bore 59. However, when stem 67 is displaced axially to separate surface 72 from shoulder 71, fluid may pass from counter-bore 69 through bore 59 and thereafter into bore 58 through a transverse bore 75 formed in body 56. It should be noted that the lower end of transverse bore 75 is tapped to receive therein a threaded sealed bolt 76 to preclude leakage from body 56.

Disposed concentrically on stem 67 and compressed between retainer 65 and a shoulder 77 formed on stem 67 is a coil spring 78. Spring 78 urges stem 67 into bore 59 thus causing the normal position of the stem to be such that surface 72 engages shoulder 71 i.e. the valve is normally closed.

Stem 67 passes out of bore 59 and through a bore 80 formed in a flange 81 formed on body 56. The end of stem 67 outside bore 59 is threaded to accommodate thereon an adjustment nut 83. Nut 83 may be adjusted along stem 67 to limit the degree of axial displacement thereof or to cause stem 67 to be displaced such as to maintain surface 72 away from shoulder 71 thus keeping the valve in the open position.

Considering now the operation of apparatus according to the invention, top 40 is removed from second liquid container 14 and a suitable charge of liquid detergent is placed therein. Thereafter the top is replaced and secured so as to form a pressure type seal.

With top 40 in pressure sealing engagement with container 14, high pressure air from a suitable source is introduced through source line 48 and regulator 49 into container 14 and through connector 42 and line 45. The pressure in container 14 may be adjusted as desired to achieve the proper flow of detergent according to desired operations. The amount of detergent and pressures involved may be determined empiracally.

First liquid container 12 is then filled to desired level with water by admitting water through line 21 and premitting the flow of water to continue therethrough until the level of water in the tank is such as to cause float valve 24 to close. As was discussed above, this level should be well up in the tank but is somewhat below the level of drain line 28.

At this stage pump 18 may be activated whereupon water will be pumped from tank 12 through tee 34 and, assuming proper venting, into hose 38 up to the position of nozzle 16. When hose 38 is completely filled with water while nozzle 16 is closed, further operation of the pump will cause the water to be recirculated through recirculating line 35 back into tank 12 for reuse.

Actuation of nozzle 16 causes water to flow through hose 38 and mixing valve 54 out nozzle 16. The water is isolated from mixture with the detergent solution until such time as stem 67 of mixing valve 54 is displaced axially to cause valve surface 72 to be displaced from seat 71. At this point detergent passes through the valve and transverse bore 75 into bore 58, is mixed with the flowing water and emerges from nozzle 16 to effect desired cleaning. Rinsing may be achieved by displacing valve stem 67 axially to cause receiving of valve surface 72 on shoulder 71 thereby terminating the flow of liquid detergent and causing the stream flowing through nozzle 16 to once again be exclusively watered.

As will be recognized by those having skill in these arts, the materials from which the apparatus may be manufactured may be selected from many of the many known in the arts depending upon the particular detergents used or the particular fluids utilized. In this regard the apparatus may be used to effect single and combined liquid streams without regard to what particular liquid may be involved. Accordingly, the materials are chosen from among those best suited for particular operations.

As will also be recognized by those skilled in these arts, the foregoing structure provides for the mixture of the two fluids on command at the mixing valve which is positioned immediately adjacent the nozzle, provides for preselection capability of fluid combination ratios, provides for isolation of a main source of water supply from a potentially contaminated fluid and provides for continued operation of the pump during all operating periods so that starting and stopping is precluded and instant flow of water to the nozzle is achievable.

With respect to the utilization of the apparatus of the invention in the cleaning fields, it will be recognized that the features of the invention in their combination have not been heretofore known in the arts and provide significant advantages with respect to achieving efficient operation.

It will also be recognized by those skilled in the arts that many modifications and variations can be made from the embodiment presented in the detailed description without departing from the spirit and scope of the invention.

What is claimed is:

1. Apparatus for providing selectively a stream flow of a first liquid and a stream flow of said first liquid combined with a second liquid, comprising:

a first liquid storage tank for storing said first liquid in anticipation of use;

a second liquid storage tank for storing said second liquid in anticipation of use;

a nozzle means for discharging as a stream flow either said first liquid or said first liquid combined with said second liquid, said nozzle means including an inlet opening, a discharge opening and valve means for permitting or interrupting the flow of fluid therethrough;

mixing valve means, said mixing valve means for selectively mixing said first liquid and said second liquid, said mixing valve means including a first inlet opening, a second inlet opening and an outlet opening, said outlet opening of said mixing valve means being in fluid communication with said inlet opening of said nozzle means;

drain means secured to said first liquid storage tank for limiting the level to which said first fluid may fill said first liquid storage tank;

pump means for pumping said first liquid into a supply hose, said supply hose extending from the discharge of said pump means to said first inlet opening of said mixing valve means;

source connection means disposed on said first liquid storage tank vertically above the level of the level of connection means for connecting said first liquid storage tank to a source of said first fluid;

outlet means on said first liquid storage tank, said outlet means for providing fluid communication between said first liquid storage tank and the inlet of said pump means;

pressure connection means disposed on said storage tank, said pressure connection means for accommodating the connection of said second liquid storage tank to a source of high pressure fluid to propel said second liquid out of said second liquid storage tank; and an outlet line in fluid communication with and secured to said second liquid storage tank, said outlet line for carrying said second fluid from said second fluid storage tank to said second inlet opening of said mixing valve.

2. Apparatus according to claim 1 wherein said pump means pumps said first liquid selectively into said supply hose or a recirculating line, said recirculating line extending from the discharge of said pump means to said first liquid storage tank at a point vertically below the level of connection of said drain means to said first liquid storage tank.

3. Apparatus according to claim 1 wherein said mixing valve means comprises a block having first and second parallel bores extending therethrough, said first bore defining said first inlet opening at one end and said outlet opening at its other end, a third bore formed in said block for placing said first and second parallel bores in fluid communication and means disposed in said second parallel bore for selectively permitting or interrupting a flow of fluid between said first and second parallel bores.

* * * * *